United States Patent [19]

Badali

[11] Patent Number: 4,723,369

[45] Date of Patent: Feb. 9, 1988

[54] BOLT ASSEMBLY

[75] Inventor: Joseph A. Badali, Ogden, Utah

[73] Assignee: Browning Arms Company, Morgan, Utah

[21] Appl. No.: 828,504

[22] Filed: Feb. 11, 1986

[51] Int. Cl.[4] ..... F41C 13/00

[52] U.S. Cl. ..... 42/17; 42/16

[58] Field of Search ..... 42/16, 17, 18, 25

[56] References Cited

U.S. PATENT DOCUMENTS

| | | | |
|---|---|---|---|
| 1,132,044 | 3/1915 | Stamm | 42/16 |
| 2,881,547 | 4/1959 | Butler | 42/16 |
| 3,142,922 | 8/1964 | Ruger | 42/17 |
| 3,345,771 | 10/1967 | Silsby | 42/18 |
| 3,710,492 | 1/1973 | Tirrell | 42/16 |
| 3,952,441 | 4/1976 | Tant | 42/18 |
| 3,979,849 | 9/1976 | Haskins | 42/16 |

*Primary Examiner*—Stephen C. Bentley
*Assistant Examiner*—Michael J. Carone
*Attorney, Agent, or Firm*—Trask, Britt & Rossa

[57] ABSTRACT

A bolt assembly for a firearm is constructed with three locking lugs, one of which is oriented down in unlocked condition as it is withdrawn past the magazine of the firearm. The body of the bolt is of reduced diameter with respect to the bolt head which carries the locking lugs. A cartridge depressor is mounted in association with the bolt body to effectively increase the diameter of the bolt body in the vicinity of the magazine to that of the bolt head.

10 Claims, 4 Drawing Figures

BOLT ASSEMBLY

BACKGROUND OF THE INVENTION

1. Field

This invention pertains to bolt action firearms and provides a bolt assembly which combines the advantages of a small diameter ninety degree bolt action with the advantages of a sixty degree bolt action.

2. State of the Art

Most firearms include a stock and a barrel with a muzzle end and a breach end mounted to the stock. The barrel is integral or otherwise associated with a receiver in the vicinity of the breach end. A magazine for shells may be associated with the receiver, and a chamber is provided on the breach end of the barrel adjacent the receiver. Cartridges stored in the magazine are fed in sequence through the receiver into the chamber through operation of the "action" of the firearm.

A common form of firearm, particularly rifles, is that known as a "bolt action." Such firearms include a bolt assembly which is operated to chamber a cartridge and lock it into battery position ready for firing. After firing, the bolt assembly is operated to extract and eject the fired cartridge. Usually, such firearms include a magazine with an entry in communication with the receiver of the firearm so that as a spent cartridge is ejected, a fresh cartridge moves up into the receiver between the chamber and the bolt assembly. The bolt assembly is then slid forward to chamber the fresh cartridge and is again locked into battery position.

The bolt assembly serves a number of important functions, and thus includes a number of structural and functional elements. Components carried by the bolt assembly operate in cooperation with other components of the assembly or structures associated with the receiver of the firearm to chamber, extract and eject cartridges in sequence as they are fed from the magazine through the receiver and then to the chamber of the firearm. Other assembly components interact so that during the process of ejecting an extracted cartridge and chambering a fresh cartridge, the action of the firearm is cocked, and in some instances, a safety device is simultaneously moved to a "safe" condition. Accordingly, a typical bolt assembly may include a bolt body which is usually approximately cylindrical and mounted with its longitudinal axis approximately parallel the longitudinal axis of the barrel, a bolt handle extending from the bolt body, a bolt handle pin (for fastening the bolt handle to the bolt body), a bolt head which carries locking lugs or other suitable locking mechanisms, a bolt head key pin for coupling the bolt head to the bolt body, a bolt shroud for housing various firing pin components, and a number of ancillary components necessary for the extracting, ejecting and firing functions of the firearm, including various springs, pins, sears, and washers.

It is conventional practice in a bolt assembly to include a gas stop subassembly with projections configurated approximately the same as the locking lugs on the bolt head. The gas stop projections thus enter the locking lug grooves following the locking lugs and remain in position in those grooves when the bolt body is rotated to urge the locking lugs into engagement with locking structure associated with the receiver. The gas stop subassembly is thus fixed longitudinally with respect to the bolt body, but is mounted to permit rotational movement of the bolt body while the gas stop projections remain in place within the lug grooves.

The multiple functions and components required of a bolt assembly impose constraints on its design. Heretofore, designers have been compelled to make choices and compromises to the detriment of some of the preferences gun operators (shooters) hold for specific features. For example, it is considered desirable that a firearm be as lightweight as practicable consistent with the requirements of durability and reliability. In the specific case of a bolt action firearm, a balance must be drawn among several factors in determining the amount of rotation required of the bolt assembly or the bolt body by operation of the bolt handle. Because rotation of the bolt is relied upon for cocking action, sufficient rotation should be provided to effect this action without undue force requirements. On the other hand, if too much rotation is required to release the bolt from its battery position, an undue amount of time is required for ejecting the spent cartridge and loading a fresh cartridge.

Experience has shown that ninety degrees of rotation, while acceptable, tends to be unduly time-consuming and imposes undesirable limitations on the available mounting positions of a scope. Ninety degrees of bolt rotation does, however, permit the location of locking lugs such that they may be oriented in non-interfering locations with respect to a magazine when the bolt is withdrawn through the receiver during the ejection and reloading cycle of the bolt assembly. For this reason, relatively light-weight bolt assemblies utilizing small diameter bolt bodies are feasible with ninety degree bolt assemblies.

A more ideal bolt assembly from the standpoint of operational features, notably rapid loading and close mounting of scopes, is an assembly which permits unlocking from battery position with a sixty degree rotation of the bolt body. Such assemblies, commonly referred to as "short throw bolts," "sixty degree bolts," or "sixty degree bolt assemblies" may actually rotate somewhat less than or more than sixty degrees, but utilize rotations sufficiently close to sixty degrees to be readily distinguished from ninety degree bolt assemblies.

One of the advantages of sixty degree bolt systems is the utilization of radially spaced locking lugs. Typically, three such lugs are provided in a set on the perimeter of the bolt head straddling radii spaced approximately 120° from each other. The lugs occupy approximately half the perimeter of the cross-section of the bolt head and provide a good uniform bearing surface to resist the explosive forces generated in the chamber of the firearm when the gun is fired. Sometimes, a plurality of sets of lugs is provided to increase the explosion-resisting bearing surface area.

The necessary or desirable location of other components of the bolt assembly, as well as other design considerations of a firearm, establish the practical orientations of the locking lugs when the bolt assembly is in its unlocked condition. Inevitably, the travel path of one of the lugs as the bolt assembly is withdrawn from battery position rearwardly to eject a spent cartridge, crosses the entry of the magazine. That is, one lug, which may be regarded as a "bottom" lug, is inevitably oriented downwardly during the reloading operation of the firearm. Typically, the magazine is located beneath the receiver so that fresh cartridges are inserted upward into the receiver as the bolt is withdrawn past the magazine location. The locking lug carried by the bolt head is oriented down to register with a locking lug groove in the bottom of the receiver portion of the gun directly behind the chamber. Because of this necessary orientation of the locking lug, it has been considered essential in sixty degree bolt assemblies that the diameter of the bolt body be sufficient to hold cartridges down into the magazine below the level of the locking lug. Otherwise, cartridges would rise up into the receiver sufficiently to interfere with the lug during its rearward travel. To avoid this difficulty, it has been conventional practice to provide bolt bodies of the same or greater diameter than the locking lugs for sixty degree bolt assemblies. These large diameter bolt bodies add weight and require a somewhat larger receiver than is customary for ninety degree bolt assemblies.

There remains a need in the firearms art for a bolt assembly which offers the advantages of a sixty degree bolt assembly without the attendant disadvantages imposed by a large diameter bolt body.

SUMMARY OF THE INVENTION

The instant invention provides a bolt assembly for bolt action firearms which retains the advantages of short throw bolts (notably, sixty degree bolt assemblies) while avoiding the necessity for large diameter bolt bodies normally characteristic of such short throw bolt assemblies. These advantages are obtained through the use of a cartridge depressor included as an element of the bolt assembly.

The cartridge depressor may conveniently be integral with a gas stop subassembly. In fact, in the preferred embodiments of the invention, the improvement of this invention may be regarded as a modified gas stop subassembly in combination with a bolt body of the small diameter characteristic of a ninety degree bolt assembly. The modified gas stop subassembly functions to make feasible the use of such smaller diameter bolt bodies in a sixty degree bolt assembly. A cartridge depressor element is disposed with respect to the bolt body to be positioned adjacent the magazine entry, thereby in effect to supply a bearing surface comparable to that which would be provided by a large diameter bolt body. It is mounted so that it remains in its initial axial position, that is, it does not rotate, when the bolt body is rotated. Thus, when the bolt handle is operated to move the locking lugs into engagement with receiver structure to hold the bolt assembly in battery position, the depressor remains in the receiver adjacent the magazine. When the bolt body is rotated and withdrawn from battery to loading position, the cartridge depressor is moved across the magazine entry followed by the depending locking lug. The lowermost surface of the locking lug is approximately coplanar with the lowermost surface of the cartridge depressor. Accordingly, the cartridges are retained in the magazine until the locking lugs are pulled back through the receiver into loading position.

BRIEF DESCRIPTION OF THE DRAWINGS

In the drawings, which illustrate that which is presently regarded as the best mode for carrying out the invention.

DESCRIPTION OF THE ILLUSTRATED EMBODIMENTS

Figure 1:
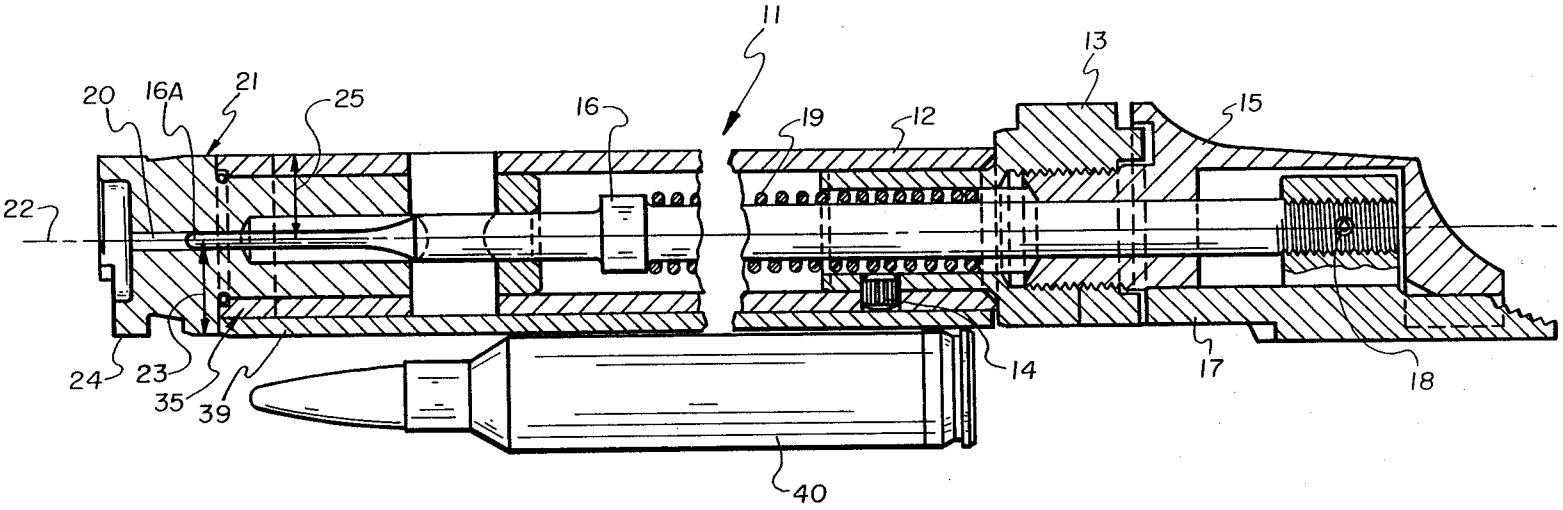
FIG. 1 is a cross-sectional view of the improved bolt assembly of this invention in its battery position showing the location of a cartridge within a magazine directly beneath the bolt assembly.

Referring to FIG. 1, a typical bolt head assembly of this invention, designated generally 11, includes a bolt body 12 with a bolt handle 13 connected to the bolt body 12 by means of a bolt handle pin 14. A bolt shroud 15 is threadedly connected to the bolt handle 13 and functions as a housing for a portion of the firing pin 16 and firing pin sear 17 which are joined internal of the bolt shroud 15 by a firing pin sear pin 18. The firing pin 16 is mounted approximately axially with respect to the bolt body 12 and is actuated by a firing pin spring 19 so that the forward end 16A of the firing pin 16 is urged through a bore 20 in the bolt head 21 upon discharge of the firearm. The center axis of the bolt head assembly, the bolt body and firing pin is designated by the numeral 22. The radius 23 of the bolt head 21, as measured from the axis 22 to the perimeter of locking lugs 24 carried by the bolt head 21, is greater than the radius 25 as measured from the same axis 22 of the bolt body 12.

Figure 2:
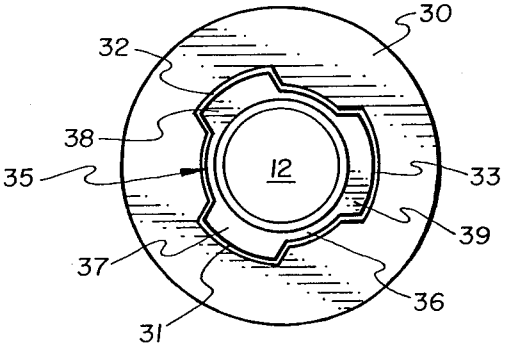
FIG. 2 is an end view of a gas stop subassembly of the bolt assembly of FIG. 1 positioned within the locking lug grooves of the receiver of a bolt action firearm.

FIG. 2 illustrates a portion of the receiver 30 of a firearm which includes locking lug grooves 31, 32, 33 through which the locking lugs 24 of the bolt head 21 pass as the bolt assembly is actuated into its forward or battery position. A gas stop subassembly, generally 35 (see FIG. 4), follows the bolt head 21 into the locking lug grooves 31, 32, 33. FIG. 2 shows the subassembly 35 in position in the locking lug grooves as is the condition when the bolt head is rotated into its locked battery position. The gas stop subassembly 35 includes a ring 36 and three projections 37, 38, 39, respectively, and is mounted to permit rotation of the bolt body 12 within the ring 36 while the projections 37, 38, 39 remain in a fixed rotational position within the grooves 31, 32, 33 (FIG. 2) with respect to the receiver 30. The projection 39, which is normally oriented downwardly with respect to the receiver 30, is fashioned as an elongate cartridge depressor element (see FIGS. 1 and 4) positioned as best illustrated by FIG. 1 to retain cartridges 40 down within the magazine (not shown) of the firearm.

Figure 3:
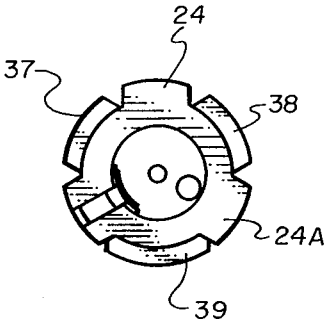
FIG. 3 is an end view of the bolt head rotated to its locked condition and the gas stop subassembly in its normal sealed position.

FIG. 3 illustrates the relative positioning of the locking lugs 24 and the projections 37, 38, 39 of the gas stop subassembly 35 in locked condition.

Figure 4:
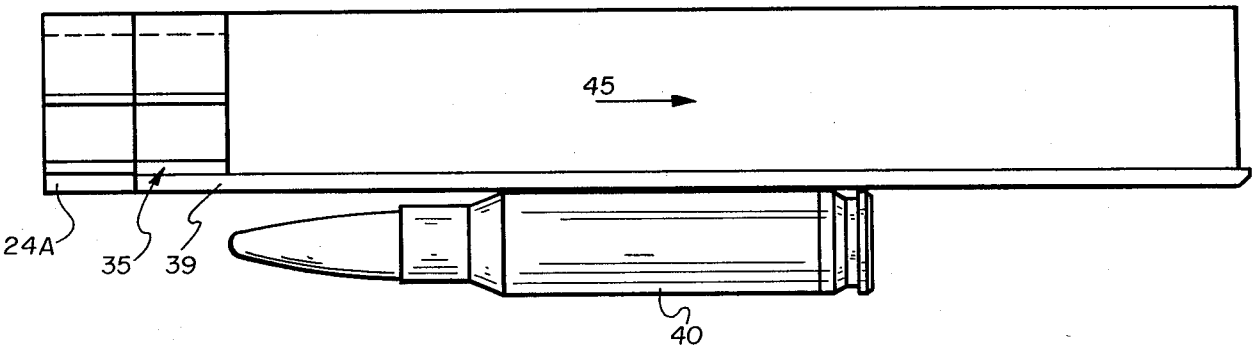
FIG. 4 is a schematic view of the bolt body, bolt head, and gas stop subassembly including a cartridge depressor, the assembly being in unlocked condition for movement through the receiver.

FIG. 4 illustrates the relative position of the locking lug 24A which is oriented down in unlocked condition and the cartridge depressor 39. As the bolt assembly is withdrawn from its battery position in the direction of the arrow 45, the cartridge depressor 39 holds the cartridge 40 down to the level of the bottom locking lug 24A so that the cartridge 40 cannot interfere with withdrawal of the bolt assembly.

In operating the bolt assembly of this invention, the assembly is first rotated from its locked battery position to an unlocked condition by operation of the bolt to rotate the locking lugs to the position illustrated by FIG. 4. The bolt is then withdrawn past the magazine area occupied by the cartridge 40 so that a cartridge can enter the receiver of the firearm on the muzzle side of the bolt head 21. The bolt assembly is then pushed forward opposite the direction of the arrow 45 to urge the cartridge 40 into the chamber of the firearm. To do so, the locking lugs 24 of the bolt head 21 pass through the locking lug grooves 31, 32, 33. The bolt body and the associated bolt head 21 is then rotated approximately sixty degrees to the position show in FIG. 3 so that the locking lugs 24 engage structure (not shown) associated with the receiver to resist the pressure of gases upon discharge of the firearm. Operation of the bolt as described effects a cocking action so that, through operation of the firing pin sear by a trigger mechanism (not shown), the firearm may be discharged.

To remove a cartridge, whether or not fired, from the chamber, the bolt is again rotated and withdrawn in the direction of the arrow 45 to extract and eject the cartridge and permit entry into the receiver of a subsequent cartridge 40 from the magazine area of the firearm. In each case in which the bolt assembly is moved past the magazine, the cartridge depressor 39 prevents movement of cartridges 40 into contact with the bolt body, that is, to a position which would interfere with the withdrawal of the locking lug 24A from the locking lug groove 33. Because the gas stop subassembly 35 remains positioned, that is, does not rotate, when the bolt body 12 and bolt head 21 are rotated by operation of the bolt handle 13, the cartridge depressor 39 permits the bolt assembly 11 to function as though it had a large diameter bolt body characteristic of the sixty degree bolt assemblies in current use.

Reference herein to details of the illustrated embodiments is not intended to limit the scope of the appended claims which themselves define the invention by reference to those details regarded as significant.

I claim:

1. A bolt assembly for a firearm having a stock, a barrel with a muzzle end and a breech end mounted to said stock, a receiver associated with said barrel in the vicinity of its breech end, a magazine for shells operably associated with said receiver, and a chamber in said barrel adjacent said receiver, comprising:

an approximately cylindrical bolt body mounted with its longitudinal axis approximately parallel the longitudinal axis of the barrel of said firearm so that it can selectively be slid longitudinally towards the muzzle end of said barrel into a battery position or longitudinally towards the breech end of said barrel into a loading position, said bolt assembly thereby being moved within the receiver of said firearm adjacent said magazine;

a handle rigidly connected to said bolt body to rotate said bolt body approximately sixty degrees about its longitudinal axis while it is in its battery position selectively between a locked condition and an unlocked condition and constituting means for sliding said bolt body longitudinally between its battery and loading positions while it is in its unlocked condition;

a bolt head with locking mechanism mutually adapted to structure associated with said receiver to lock said assembly into battery position when said bolt body is rotated to it locked condition and to release said assembly for sliding motion when said bolt body is rotated to tis unlocked contition; and a cartridge depressor associated with said bold body and positioned between said body and said magazine constituting means for holding cartridges stored in said magazine out of said receiver during the interval in which the bolt body is rotated to its unlocked condition and slid from its battery position towards its loading position, said cartridge depressor associated with a gas stop subassembly, said cartridge depressor and said gas stop subassembly rotatably mounted on said bolt body to maintain a constant rotational orientation relative to said receiver as said bolt body is rotated.

2. A bolt assembly according to claim 1, wherein said locking mechanism is comprised of a set of three locking lugs circumferentially and evenly spaced about said bolt head, said locking lugs configured and adapted to register with locking lug grooves associated with said receiver.

3. In a firearm of the type which has a bolt assembly slidably mounted within a receiver and operably associated with a magazine, the bolt assembly including a bolt body, a bolt head with locking lugs adapted to register with locking lug grooves in the receiver, and a bolt handle rigidly connected to said bolt body to rotate said bolt head and to slide said bolt body, thereby selectively to engage or disengage locking structure in said receiver with said looking lugs and selectively to place said bolt assembly in a locked battery position in which the bolt assembly occupies the reciever so that cartridges cannot enter the receiver from the entry of said magazine and thereafter to rotate said bolt head to disengage said structrue and to slide said bolt assembly, including sad locking lugs through said reciever and past said magazine to permit entry of a cartridge from said magazine into said receiver, the improvement which comprises:

a plurality of said locking lugs in association with said bolt head adapted to engage or disengage, respectively, said structure upon rotation of said bolt head approximately sixty degrees, said lugs being in registration, in unlocked condition, with a corresponding plurality of locking lug grooves, thereby permitting said bolt assembly to be moved through the receiver so that one of said locking lugs is moved past the entry of said magazine;

an approximately cylindrical bolt body of smaller radius than said one of said locking lugs; and a cartridge depressor in association with said bolt body adjacent said one of said locking lugs constituting means for preventing the entry of a cartridge into the receiver until said one of said locking lugs is moved to the breech end of said receiver, said cartridge depressor being connected to a gas stop subassembly which is rotatably mounted on said bolt body to maintain said gas stop subassembly and said cartridge depressor in a constant rotational orientation relative said receiver as said bolt body is rotated.

4. A bolt assembly according to claim 1 wherein said cartridge depressor is an elongated member having a semicylindrical exterior shape and a longitudinal axis parallel the longitudinal axis of said bolt body.

5. A bolt assembly according to claim 4 wherein said cartridge depressor associates with a lower gas stop projection of said gas stop subassembly.

6. A firearm according to claim 3 wherein said cartridge depressor has a semi-cylindrical exterior shape and a longitudinal axis parallel the longitidinal axis of said bolt body.

7. A firearm according to claim 6 wherein said cartridge depressor connects to a lower gas stop projection of said gas stop subassembly.

8. A cartridge depressor and gas stop subassembly for a bolt assembly of a firearm which has a plurality of locking lug grooves at the chamber end of a receiver and a magazine in open communication with said receiver adjacent one of said locking lug grooves, comprising:

a gas stop ring with an internal bore adapted to receive the bolt body of said bolt assembly; and a plurality of gas stop projections arranged and configurated to enter and seal said locking lug grooves, the projection adapted to said groove adjacent said magazine being elongated in the direction parallel the axis of said bolt body to present a surface adjacent the magazine constituting means for retaining cartridges in said magazine in noninterfering relation with said locking lug groove.

9. A cartridge depressor and gas stop subassembly according to claim 8 wherein there are three of said gas stop projections circumferentially and evenly spaced about said gas stop subassembly.

10. A cartridge depressor and gas stop subassembly according to claim 8 wherein said cartridge depressor has a semicylindrical exterior shape and a longitudinal axis parallel the longitudinal axis of said bolt body.

* * * * *